US009486804B2

(12) United States Patent
Boast et al.

(10) Patent No.: US 9,486,804 B2
(45) Date of Patent: Nov. 8, 2016

(54) CONE CRUSHER

(71) Applicant: Terex GB Limited, Leicestershire (GB)

(72) Inventors: Ian Boast, Leicestershire (GB); Tim Cummins, Leicestershire (GB); Andrew Plimsaul, Leicestershire (GB)

(73) Assignee: Terex GB Limited, Leicestershire (GB)

( * ) Notice: Subject to any disclaimer, the term of this patent is extended or adjusted under 35 U.S.C. 154(b) by 511 days.

(21) Appl. No.: 13/912,722

(22) Filed: Jun. 7, 2013

(65) Prior Publication Data

US 2013/0327865 A1 Dec. 12, 2013

(30) Foreign Application Priority Data

Jun. 12, 2012 (GB) ..... 1210326.3

(51) Int. Cl.
*B02C 2/00* (2006.01)
*B02C 2/04* (2006.01)

(52) U.S. Cl.
CPC ..... *B02C 2/00* (2013.01); *B02C 2/005* (2013.01); *B02C 2/04* (2013.01); *B02C 2/047* (2013.01); *Y10T 29/49947* (2015.01)

(58) Field of Classification Search
CPC ..... B02C 2/00; B02C 2/02; B02C 2/04; B02C 2/06; B02C 2/005
USPC ..... 241/207, 209
See application file for complete search history.

(56) References Cited

U.S. PATENT DOCUMENTS 2,341,544 A * 2/1944 Gruender ..... B02C 2/005 241/207
5,653,393 A 8/1997 Tanaka et al.
6,129,297 A * 10/2000 Sawant ..... B02C 2/005 241/101.3
7,048,214 B2 * 5/2006 Johnson ..... B02C 2/00 241/207
7,229,040 B2 * 6/2007 Juhlin ..... B02C 2/005 241/207
7,467,756 B2 * 12/2008 Juhlin ..... B02C 2/005 241/101.3
8,832,921 B2 * 9/2014 Marks ..... B02C 2/005 241/207
2004/0035967 A1 * 2/2004 Johnson ..... B02C 2/00 241/207
2006/0086852 A1 * 4/2006 Juhlin ..... B02C 2/005 241/207

FOREIGN PATENT DOCUMENTS

CN 201543448 U 8/2010
GB 1118956 A 7/1968
GB 1449806 A 9/1976
WO 2011025088 A1 3/2011

OTHER PUBLICATIONS

Search Report Under Section 17(5) issued Oct. 5, 2012 in corresponding application No. GB1210326.3 (6 pages).

* cited by examiner

*Primary Examiner* — Faye Francis
(74) *Attorney, Agent, or Firm* — Osha • Liang LLP

(57) ABSTRACT

A cone crusher including a conical body; a mantle removably positioned over the conical body, and an assembly for securing the mantle on the conical body. The assembly includes a retainer for pressing the mantle onto the conical body, and an adapter located between the retainer and the conical body. The adapter is secured on the conical body and the retainer is movably mounted on the adapter.

8 Claims, 11 Drawing Sheets

CONE CRUSHER

FIELD OF INVENTION

The present invention relates to a cone crusher, and/or a method of assembling a cone crusher.

BACKGROUND

A cone crusher is used for crushing materials such as rocks, stones and ores. A typical cone crusher has a conical body arranged to rotate eccentrically with respect to a concave element mounted on an upper frame. The eccentric rotation of the conical body with respect to the concave element means that gap between the body and concave element opens and closes, thus crushing material therebetween.

It will be appreciated that the outside surface of the conical body and the inside surface of the concave element can be subject to high levels of wear during use of the crusher. To combat the high levels of wear, the outer surface of the conical body and/or the inside surface of the concave element are replaceable or provided with a sacrificial lining.

FIG. 1 shows a cone crusher 110 of the prior art. A conical mantle 112 is positioned over a conical body 114 of the cone crusher. The mantle 112 is clamped to the conical body using a single nut 116, which engages a large diameter cylindrically shaped neck 118 at the upper end of the conical body. When the nut 116 is tightened, it presses the mantle 112 into compressive engagement with the conical body 114.

During operation of the cone crusher, the conical body 114 rotates eccentrically, so as to crush material between the mantle 114 and a lining of the concave cover. However, contact with material to be crushed (e.g. a rock or a stone) may cause the mantle 112 to temporarily stop rotating or to temporarily rotate slower than the conical body 114. Such relative rotational motion can cause relative rotation between the nut 116 and the conical body 114, resulting in the nut 116 becoming loosened from the conical body 114.

To prevent the nut 116 being loosened from the conical body 114 by this movement, the thread on the nut 116 is provided in a direction such that the nut 116 tightens during operation rather than loosens. Nevertheless, prior to operation of the cone crusher, the nut 116 must be securely tightened onto the conical body 114. This requires considerable torque and typically this can only be applied by the use of a sledge hammer, which can have safety implications.

FIG. 6 shows an upper frame assembly of a known cone crusher, having a concave element 150 with a sacrificial liner 152. The liner 152 has lugs 154 that are configured to overlap a portion of the concave element 150. The liner 152 is jacked into engagement with the cover 150 using wedges 156 between the lugs 154 and the cover 150. Positioning the wedges is a physically exerting task which often requires the use of a T-bar and a sledge hammer, and thereby raises safety issues.

SUMMARY OF INVENTION

There is a need to alleviate one or more of the above mentioned problems.

According to a first aspect of the present invention there is provided a cone crusher comprising:

a conical body;

a mantle removably positioned over the conical body; and an assembly for securing the mantle on the conical body, said assembly comprising a retainer for pressing the mantle onto the conical body, and an adapter located between the retainer and the conical body, wherein the adapter is secured on the conical body and the retainer is movably mounted on the adapter.

The assembly of retainer and adapter provides a novel and advantageous solution to problems associated with the single nut retention mechanism of the prior art.

In embodiments, the retainer and adapter are separate interconnected components moveable relative to one another.

The connection between the adapter and the retainer may be configured such that the retainer is rotatable relative to the adapter. In such embodiments, in use, when the mantle experiences a resistance to motion the retainer can rotate relative to the adapter to tighten the retainer relative to the mantle.

The retainer may be annular in shape and positioned coaxially with the adapter. The retainer may be threadingly engaged with the adapter, e.g. on an outer surface of the adapter.

The adapter may be directly fastened to the conical body.

The adapter may be fastened to the conical body using two or more fasteners. The fasteners may be provided within an area corresponding to an upper surface of a neck of the conical body, and/or the diameter of the fastener may be less than the diameter of a neck of the conical body. This can massively reduce the amount of torque required to tighten or untighten the fasteners compared to the single nut of the prior art.

The fasteners may extend through bores provided in the adapter to fasten to the conical body, for example, to fasten to a neck of the conical body. For example, the adapter may take the form of a plate, wherein the bores extend from an upper surface to a lower surface of the plate, so that the fasteners can pass down through the plate for tightening engagement into the conical body.

Each, or each combination of, the above described configurations result in the torque required to tighten each of the fasteners being reduced to a fraction of the torque required to tighten the single nut of the prior art, obviating the need for high risk solutions such as the use of a sledge hammer.

The fastener may be threaded and the bores may be a threaded bore for threadingly receiving the fastener.

The two or more fasteners may be bolts. The fasteners may be arranged circumferentially around the adapter. The cone crusher may comprise, three, four, five, six, seven, eight or more fasteners.

The cone crusher may comprise a relief ring positioned between the retainer and the mantle. The relief ring may be made from a material that is easily burnt. The relief ring can be made from any suitable material of the type well known in the art, e.g. manganese.

A resilient member may be positioned to space the adapter axially from the conical body. Spacing the adapter axially from the conical body can set the position of the adaptor to prevent the bolts 'bottoming out', which would prevent the required clamping force to the mantle being generated. The resilient member may be a spring, or a plurality of springs. One or more of the springs may be substantially coaxially aligned with one of the fasteners.

A protective cap may be positioned over the adapter and/or retainer. For example, the protective cap may be positioned on the retainer so as to at least cover the adapter. The protective cap provides a barrier to material ingress to components of the cone crusher.

According to another aspect of the present invention there is provided a method of assembly of a cone crusher, the method comprising the step of:

positioning a mantle over a conical body of a cone crusher;

providing an assembly for securing the mantle on the conical body, said assembly comprising a retainer for pressing the mantle onto the conical body, and an adapter for location between the retainer and the conical body;

the method further comprising the steps of mounting the retainer on the adapter; and securing the adapter on the conical body, in order to press the mantle onto the conical body via the retainer.

The adapter may be directly fastened to the conical body. The retainer may be directly connected to the adapter. The adapter may be positioned coaxial with the conical body. The adapter may be positioned coaxial with the conical body before the retainer is connected to the adapter.

The retainer may be connected to the adapter using a configuration such that the retainer is rotatable relative to the adapter. In such embodiments, in use, when the mantle experiences a resistance to motion the retainer can rotate relative to the adapter to tighten the abutment with the retainer and mantle.

The method of assembly may comprise the step of threadingly engaging the retainer to the adapter.

The method may comprise the step of fastening the adapter to the conical body using two or more fasteners. The fasteners may be positioned within an area corresponding to an upper surface of a neck of the conical body. The diameter of the fastener may be less than the diameter of a neck of the conical body. The fastener may be positioned to extend through bores provided in the adapter to fasten to the conical body, for example, to fasten to a neck of the conical body. Each, or each combination of, the above described configurations result in the torque required to tighten each of the fasteners being reduced to a fraction of the torque required to tighten the single nut of the prior art, obviating the need for high risk solutions such as the use of a sledge hammer.

The method of assembly may comprise the step of positioning a relief ring between the retainer and the mantle, the relief ring being made from a material that is easily burnt.

The method of assembly may comprise the step of positioning a resilient member so as to space the adapter axially from the conical body.

The method may comprise the step of tightening the fasteners to provide a preload on the adapter.

According to a further aspect of the present invention there is provided a cone crusher of the kind having:

a frame positioned over and spaced from a conical body of the cone crusher, and a concave wear element mounted on the frame, wherein the conical body is rotatable relative to the frame for crushing material between the concave wear element and the conical body, the cone crusher further comprising a jacking arrangement for moving the wear element relative to the frame, wherein the jacking arrangement includes a jacking plate arranged to act between the wear element and the frame, to provide compressive engagement between the wear element and the frame, and wherein the upper end of the wear element includes location formations configured to overlap a portion of the jacking plate, and the jacking plate is configured to allow the upper end of the wear liner to pass through the jacking plate for location or removal of the wear element relative to the jacking plate.

The cone crusher of the previous aspects of the invention may comprise one or more of the features of this aspect of the invention.

This aspect of the invention avoids the need for the jacking wedges of the prior art. Accordingly, some of the associated health and safety risks are alleviated. Moreover, it provides a frame assembly in which the wear liner can be more easily assembled on or removed from the cone crusher.

The location formations may comprise radial tugs, and the jacking plate may have an inner periphery shaped to allow the lugs on the wear element to pass through the plate.

The jacking plate may include location formations for receiving the location formations of the wear element.

The location formations on the jacking plate may comprise a tapered surface, such that, in use, relative rotation of the liner with respect to the frame causes the liner to tighten relative to the frame.

The location formations on the wear element may comprise radial lugs and the location formations on the jacking plate may comprise recesses for receiving the radial lugs.

An inner periphery of the jacking plate may include recesses configured to allow the lugs on the wear element to pass through the plate.

A location formation on the jacking plate may be provided between two of the recesses on the inner periphery of the jacking plate.

The jacking plate may be arranged to act against the lugs of the wear element for lifting the wear element relative to the frame.

The cone crusher may further include jacking bolts for jacking the wear element relative to the frame.

The jacking bolts may extend through the jacking plate for jacking against the frame.

The jacking strips may be provided between the ends of the jacking bolts and the frame.

The jacking plate may be a ring.

DESCRIPTION OF DRAWINGS

Other features and aspects of the invention will be apparent from the following description of embodiments made by way of example with reference to the accompanying drawings in which.

DETAILED DESCRIPTION

Figure 1:
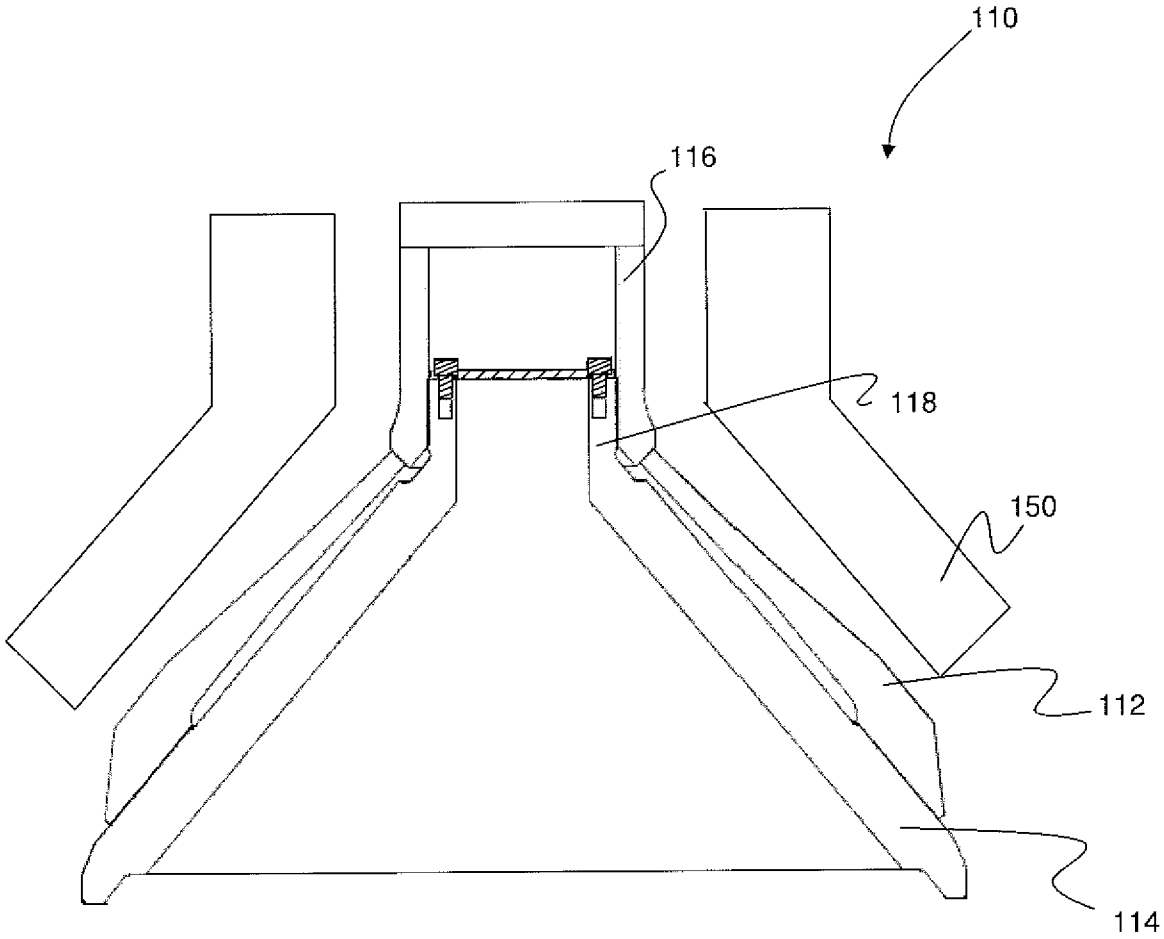
FIG. 1 shows a cross sectional view of a conical body, mantle and nut of a cone crusher of the prior art.
Figure 2:
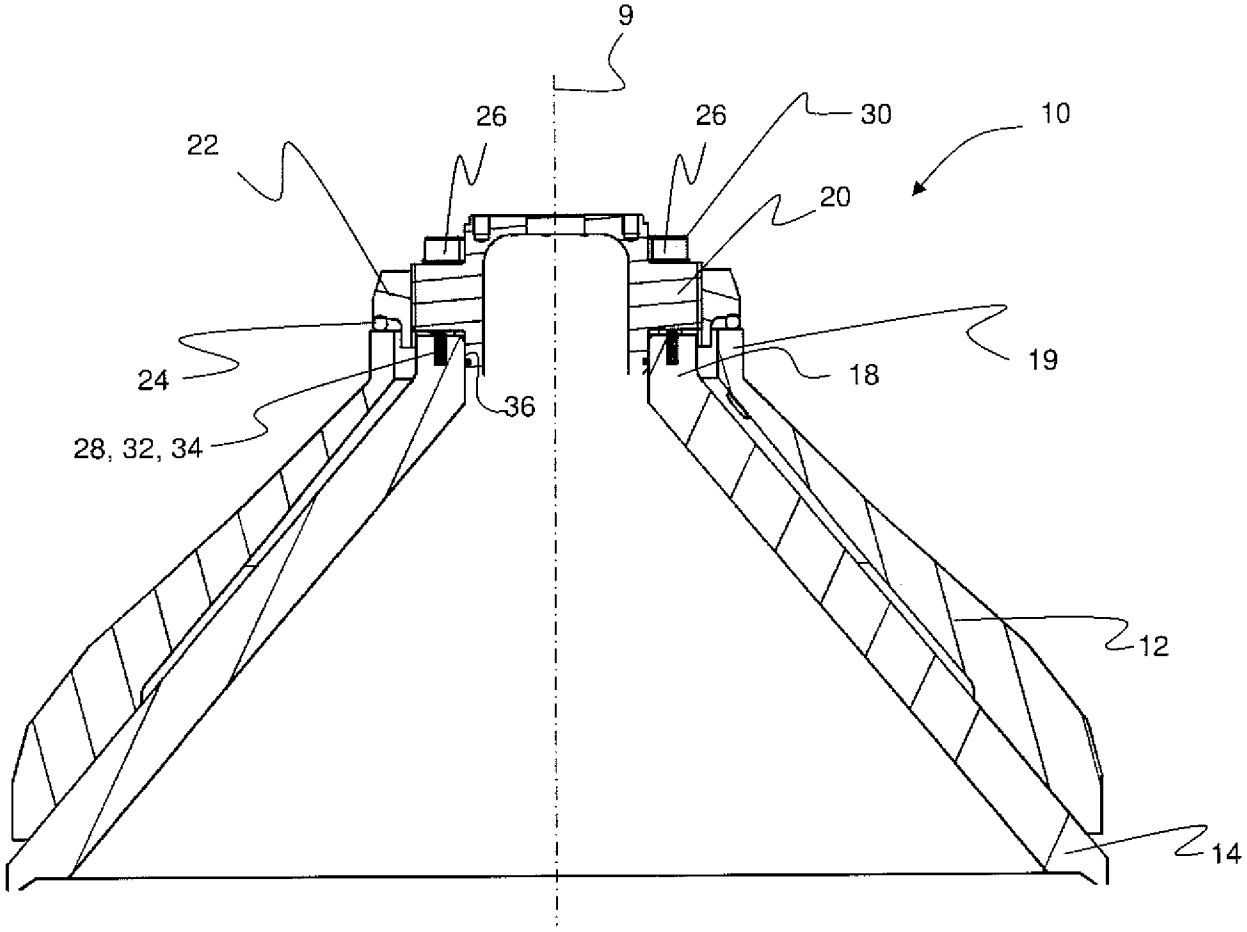
FIG. 2 shows a cross-sectional view of a cone crusher according to an embodiment of the invention.

Referring to FIG. 2, a cone crusher is indicated generally at 10. The cone crusher has a conical body 14 with a cylindrical shaped neck 18 at an upper position of the conical body 14. The neck 18 of the cone crusher 10 shown in FIG. 2 is shallower than the cylindrical neck 118 of the prior art (see FIG. 1). The reasons for this difference will become apparent in the following description, but in alternative embodiments the neck may be of a similar height to the neck of the cone crushers of the prior art.

A mantle 12 of sacrificial wear material, for example manganese, is generally conical in shape and is positioned over and coaxial with the conical body 14 (i.e. the conical body and the mantle share the same central axis 9). The mantle has a neck 19 at an upper position of the mantle body. The neck 19 is configured to be concentric with the neck 16 of the conical body 14. The angle of the sides of the mantle 12 and the conical body 14 are non-parallel, to enable the mantle 12 to be pressed into an interference fit against an outer surface of the conical body 14.

A releasable retention assembly 15 is provided for securing the mantle 12 to the conical body 14. The assembly 15 includes an adapter 20 fastened to the conical body and a retainer 22 positioned for pressing the mantle down onto the conical body.

The adapter 20 is connected to and coaxial with the neck 18 of the conical body 14. The adapter 20 is located coaxial with the neck 18 via the provision of an annular protrusion 36 that fits inside the neck 18 of the conical body 14.

The adapter 20 is fastened to the conical body 14 by, in this embodiment, four fasteners 26 (only two of which are visible in the Figures). In this embodiment, each fastener is a bolt and therefore has a threaded body 32 and a head 30. The adapter 20 has four threaded bores extending therethrough. The threaded bores are configured to engage with the thread of a respective fastener. The conical body 14 has corresponding threaded bores 28 formed at an upper end thereof, for receiving the ends of the fasteners as they extend through the adapter.

The retainer 22 is annular in shape and has a thread on an inner surface, for threaded engagement of a thread provided on an outer surface of the adapter 20. The thread is provided in a direction such that if, in use, the mantle experiences a resistance to motion the retainer rotates axially towards the mantle 12.

A relief ring 24 is positioned between the retainer 22 and the mantle 12, so as to separate the retainer and the mantle.

A resilient member, in this case a spring 34, is positioned within the bores 28 of the conical body, so as to maintain a gap between the conical body and the adapter.

Figure 3:
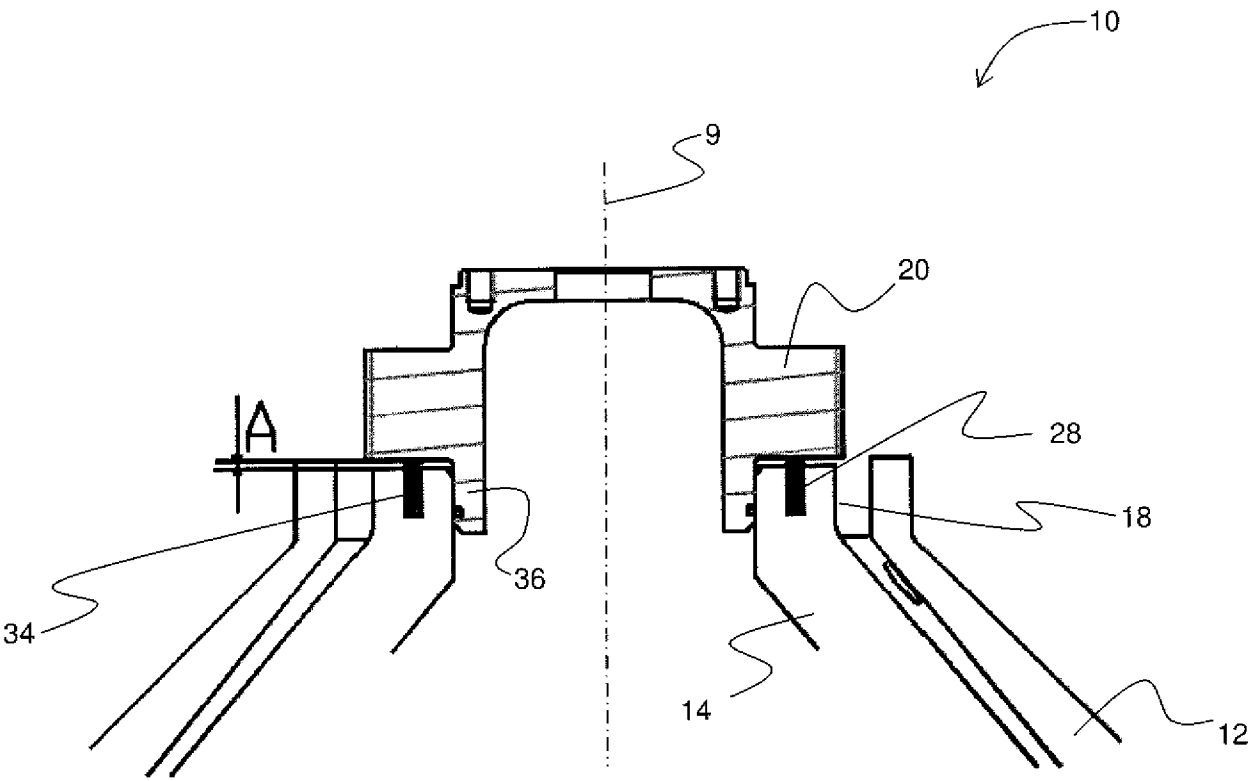
FIG. 3 shows a cross-sectional view of the cone crusher shown in FIG. 2 in a first step of assembly.

A method of assembling the cone crusher shown in FIG. 2 will now be described with reference to FIGS. 3 to 5. Firstly, referring to FIG. 3, the mantle 12 is positioned over the conical body 14. A resilient member, in this embodiment a spring 34, is positioned in each threaded bore 28 of the conical body 14 for providing a gap between the conical body and the adapter. The adapter 20 is then positioned coaxial with the conical body, but not in contact with the conical body. The lower protrusion 36 of the adapter is received in the neck 18 of the conical body 14 to aid in locating the adapter coaxially with the conical body.

Figure 4:
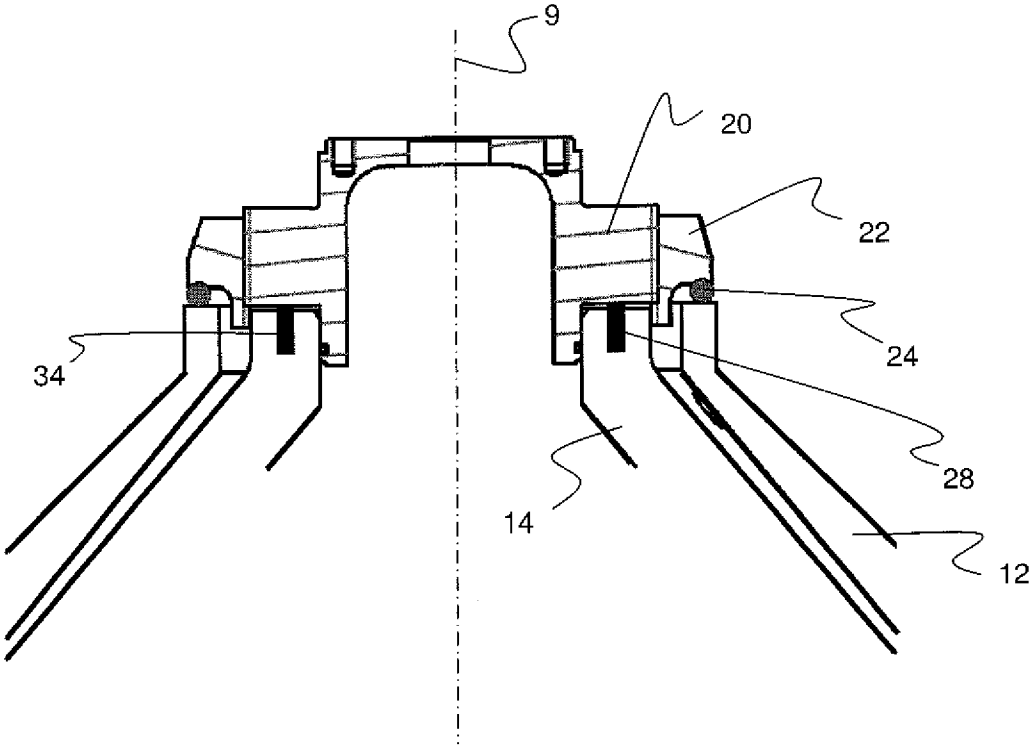
FIG. 4 shows a cross-sectional view of the cone crusher shown in FIG. 2 in a second step of assembly.

Referring now to FIG. 4, the next step of assembly includes positioning the relief ring 24 on an upper surface of the mantle 12, in this embodiment, the relief ring is substantially coaxial with the mantle 12.

The threaded surface of the retainer 22 is then threaded onto the threaded surface of the adapter 20 until the retainer abuts the relief ring 24. The abutment of the retainer with the relief ring restricts movement of the mantle away from the conical body.

Figure 5:
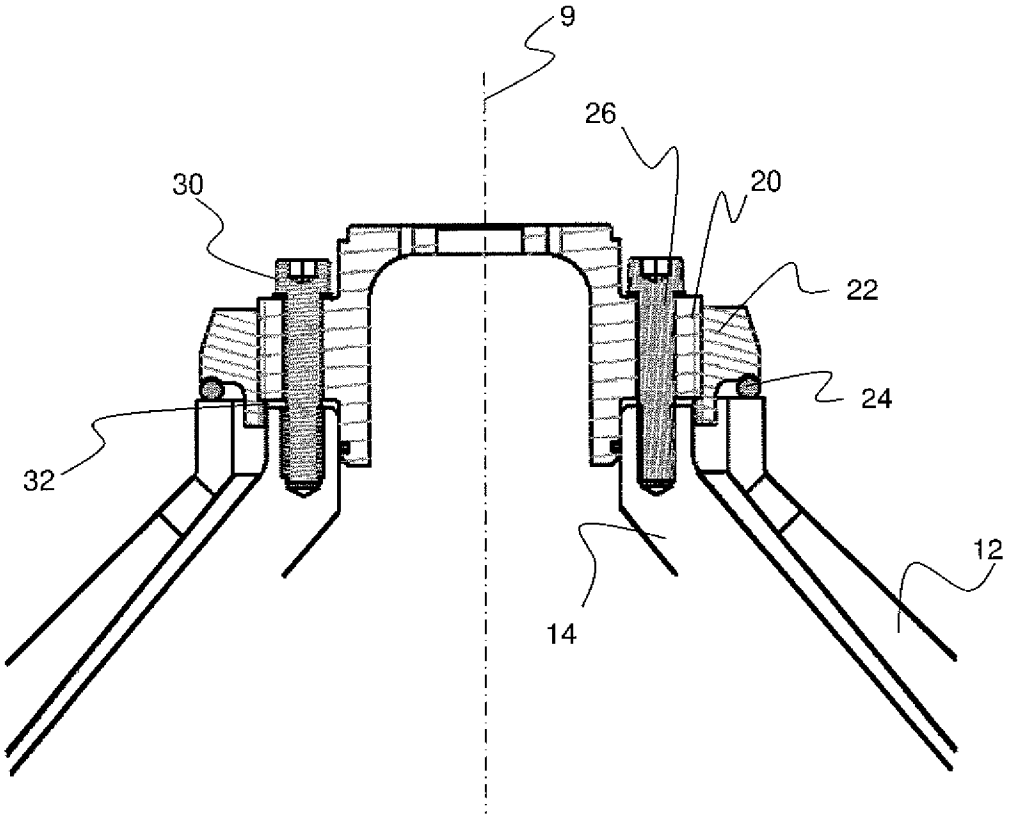
FIG. 5 shows a cross-sectional view of the cone crusher shown in FIG. 2 in a third step of assembly.
Figure 6:
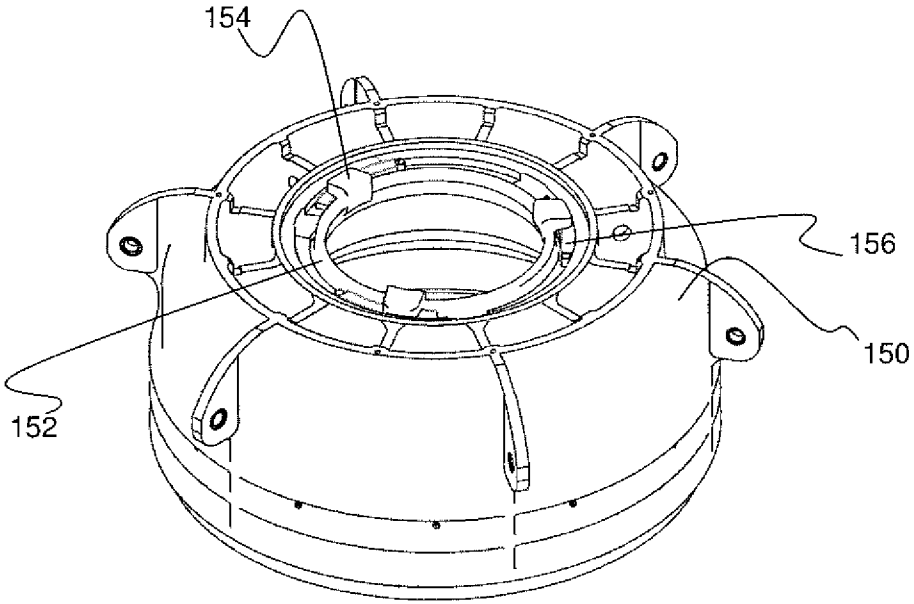
FIG. 6 shows a perspective view of a concave element and concave liner of a cone crusher of the prior art.

Referring to FIG. 5, the final stages in assembling the cone crusher are illustrated. In the final stage, the fasteners 26 are received in and threadingly engaged with the bores of the adapter. The fasteners are then further screwed into the bores 28 of the conical body 14 so as to fasten the adapter to the conical body 14. The fasteners are tightened so as to cause the retainer to push the mantle into an interference fit with the conical body and apply a preload to the mantle.

To disassemble the cone crusher of the embodiment shown in FIG. 2, the relief ring 24 is burnt away. This releases most, if not all, of the additional load that has built up during operation of the cone crusher. The fasteners 26 can then simply be removed.

In this embodiment, because of the smaller diameter of the fasteners 26 compared to the neck of the conical body (and the nut of the prior art), the adapter can be attached to and removed from the conical body 14 using a spanner or wrench, and in some cases by hand. This is advantageous over the cone crushers of the prior art which require greater physical effort and sometimes high risk solutions for applying the required torque, for example, use of a through bar and a sledge hammer.

In alternative embodiments of the invention to the embodiment described, the number of fasteners 26 may be two, three, five, six, seven, eight or any suitable number of fasteners may be positioned circumferentially around the adapter 20 body and the conical body 14.

Figure 7:
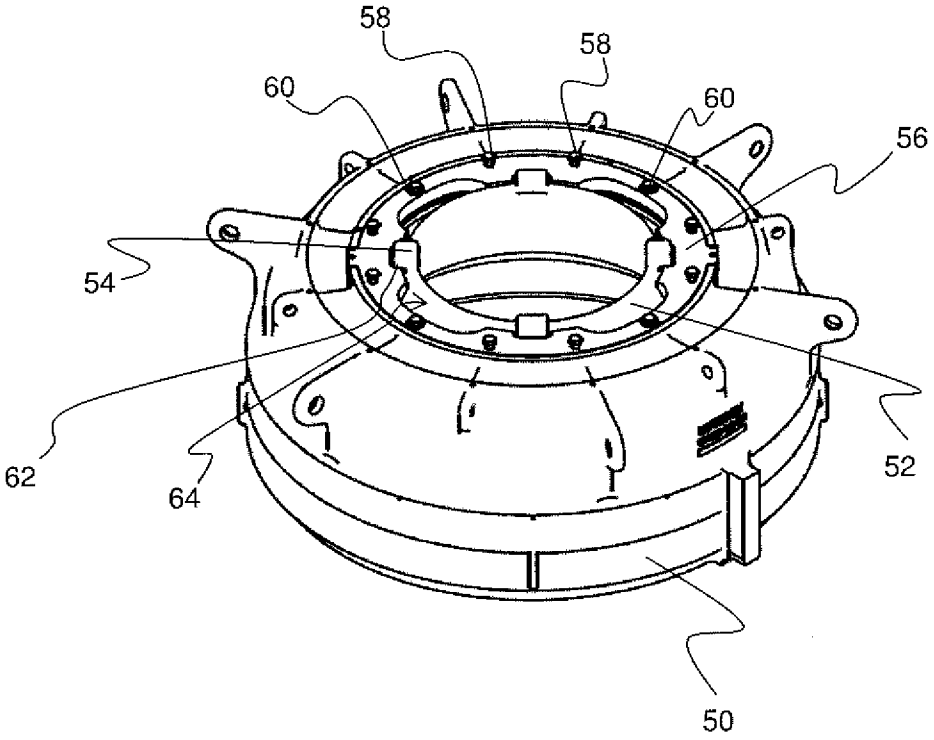
FIG. 7 shows a perspective view of a concave element and concave liner of a cone crusher according to another embodiment of the invention.

Referring now to FIG. 7, part of an upper frame of a cone crusher is shown at 50, having an associated wear liner 52.

As in the prior art, the liner 52 is positioned within the frame 50 and material is crushed between the liner 52 and a mantle positioned on an eccentrically rotating conical body below the frame 50 (e.g. the conical body and mantle previously described herein). The liner 52 is sacrificial and can be replaced when needed, e.g. once the liner 52 reaches a certain level of wear.

An upper end of the liner 52 includes lugs 54 which serve as radial projections for correctly locating the liner 52 relative to the frame 50. In this embodiment, there are four lugs 54 spaced equidistantly and circumferentially around the upper end of the liner 52.

A support or jacking plate 56 is arranged between the frame 50 and the liner 52. The lugs 54 of the liner 52 are arranged for operative engagement with the jacking plate 56. More particularly, the jacking plate 56 defines a plurality of recesses or depressions 62 into which the lugs 54 of the liner 52 are positionable, for correctly locating the liner 52 relative to the jacking plate 56.

The jacking plate 56 further defines a plurality of clearance cut-outs or recesses 60 on its inner diameter. The clearance recesses 60 are formed through the thickness of the jacking plate 56 and are wider than the lugs 54 of the liner 52, to enable the lugs 54 to pass within the clearance recesses 60, as will be described below. In this embodiment, the clearance recesses 60 are spaced equidistantly about the inner diameter of the jacking plate 56, and the locating recesses 62 are provided between the clearance recesses 60.

In some embodiments, the locating recesses 62 may have a tapered surface configured such that relative rotation of the liner 52 with respect to the frame 50 causes the liner 52 to tighten its engagement with the frame 50.

FIGS. 8 to 11 show the steps in assembling the liner 52 on the frame 50.

Figure 8:
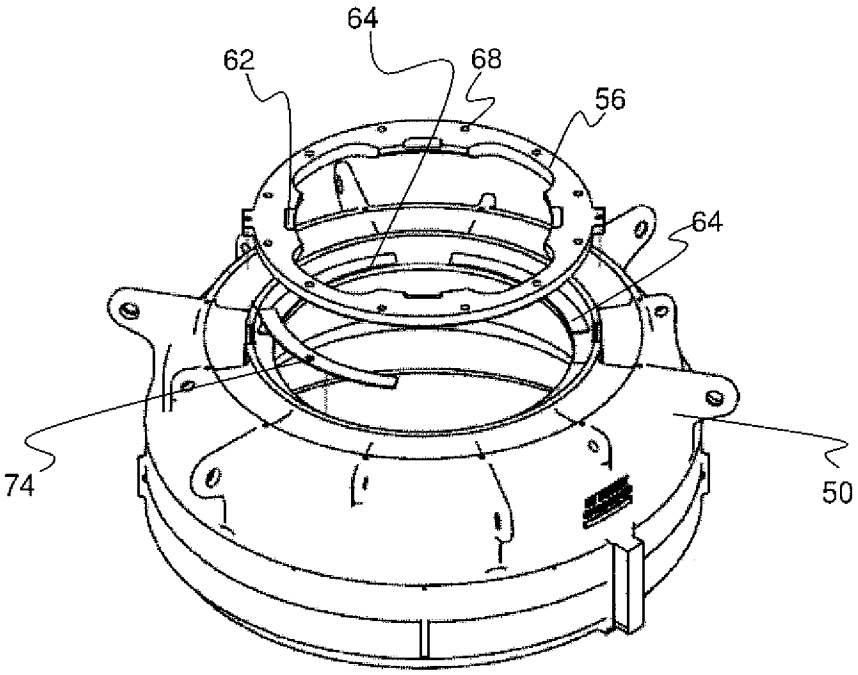
FIG. 8 shows a perspective view of a first step of assembly of the concave element and concave liner shown in FIG. 7.

As can be seen in FIG. 8, arcuate jack strips 64 (three of which are visible in FIG. 8) are mounted on an upper surface of the frame 50, e.g. adjacent the rim of the central opening in the frame 50. The jacking plate 56 is then placed on top of the jack plates 64.

Figure 9:
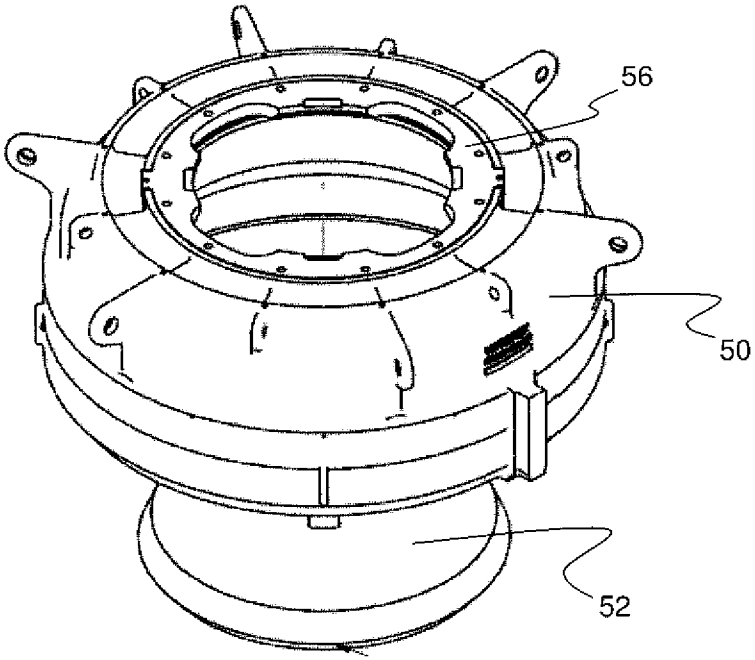
FIG. 9 shows a perspective view of a second step of assembly of the concave element and concave liner shown in FIG. 7.
Figure 10:
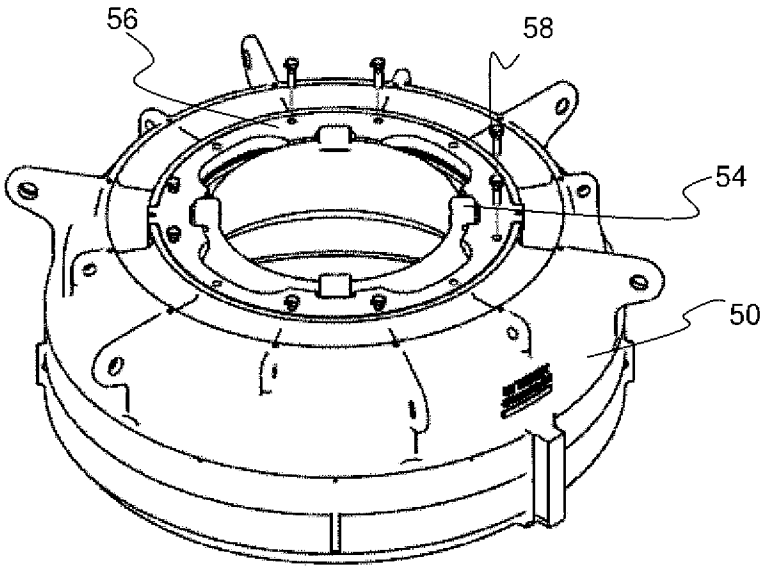
FIG. 10 shows a perspective view of a third step of assembly of the concave element and concave liner shown in FIG. 7.
Figure 11:
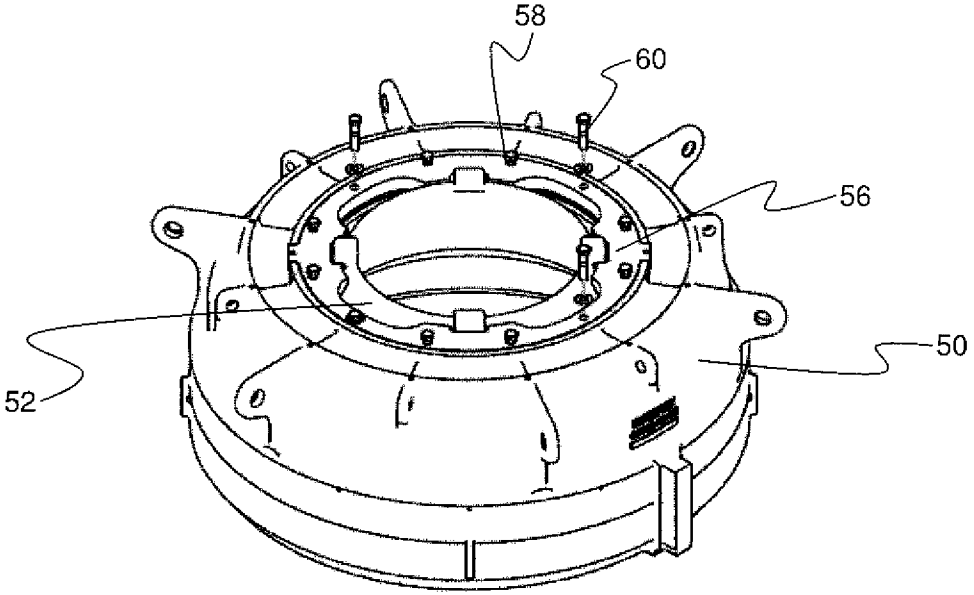
FIG. 11 shows a perspective view of a fourth step of assembly of the concave element and concave liner shown in FIG. 7.

The liner 52 is arranged below the frame 50 (e.g. as shown in FIG. 9) before being manoeuvred so that the upper end of the liner 52 passes up through the central aperture in the frame 50. To do this, the lugs 54 are positioned to pass up through the clearance recesses 60 of the jacking plate 56. The liner 52 is then rotated to bring each lug 54 into engagement with a respective locating recess 62 in the upper surface of the jacking plate 56 (e.g. as shown in FIG. 10).

Typically, the liner 52 will have an external configuration intended to mate with or lay adjacent an inner surface of the frame 50, when the lugs 54 are correctly arranged in the locating recesses 62.

A jacking arrangement is provided for jacking the jacking plate 56 and hence the upper end of the liner 52 (via the lugs 54) upwards relative to the frame 50, in order to urge the lower end of the liner 52 into compressive engagement with an internal surface of the frame 50. The jacking arrangement includes jacking bolts 58 provided to extend through the jacking plate and into engagement with the jack strips 64. The jacking bolts can be rotated in order to jack the jacking plate 56 in a manner known in the art and understood by a person skilled in the art, e.g. by cooperation with a threaded bolt. The jacking bolts 58 act against the jack strips, to prevent or reduce the risk of damage to the frame 50 during jacking of the jacking plate/liner 52. The jack strips 64 may be easily replaced if damaged, as a result of the forces generated during jacking of the liner 52.

In this embodiment, additional bolts 60 extend through the jacking plate and are threaded into the frame 50. The additional bolts 60 are positioned to be spaced between the lugs, and sets of jacking bolts in this embodiment four additional bolts are provided each being positioned equidistant from an adjacent lug. The additional bolts 60 act to limit deflection of the jacking plate 56. In alternative embodiments the additional bolts 60 may not be required.

The arrangement shown herein advantageously requires much less force exertion to securely connect the liner to the frame than the methods of the prior art.

Although the invention has been described above with reference to one or more preferred embodiments, it will be appreciated that various changes or modifications may be made without departing from the scope of the invention as defined in the appended claims.

The invention claimed is:

1. A cone crusher comprising:

a conical body;

a mantle removably positioned over the conical body; and an assembly for securing the mantle on the conical body, said assembly comprising a retainer for pressing the mantle onto the conical body, and an adapter secured on the conical body, wherein the retainer is annular in shape and is positioned co-axially with the adapter, wherein the retainer is movably mounted on an outer wall of the adapter, and wherein the adapter is mounted on the conical body such that the adapter, and hence the retainer mounted thereon, is movable towards the conical body as the adapter is secured on the conical body.

2. The cone crusher according to claim 1, wherein the connection between the adapter and the retainer is configured such that the retainer is rotatable relative to the adapter.

3. The cone crusher according to claim 2, wherein the retainer is threadingly engaged with the adapter.

4. The cone crusher according to claim 1, wherein the adapter is fastened to the conical body using two or more fasteners.

5. The cone crusher according to claim 4, wherein the fasteners are provided within an area corresponding to an upper surface of a neck of the conical body.

6. The cone crusher according to claim 4, wherein the diameter of each of the fasteners is less than the diameter of a neck of the conical body.

7. The cone crusher according to claim 4, wherein the fasteners extend through bores provided in the adapter to fasten to the conical body.

8. The cone crusher according to claim 1 comprising a resilient member positioned to space the adapter axially from the conical body.

* * * * *